United States Patent [19]

Lind

[11] 4,210,334

[45] Jul. 1, 1980

[54] GOLF CLUB INCLUDING SUPPORT ATTACHMENT

[76] Inventor: William F. Lind, 5958 Gaviota Ave., Long Beach, Calif. 90805

[21] Appl. No.: 944,755

[22] Filed: Sep. 22, 1978

[51] Int. Cl.[2] ..... A63B 55/10; A63B 53/00

[52] U.S. Cl. ..... 273/162 R; 273/163 A

[58] Field of Search ..... 273/163 R, 81.2, 81.3, 273/193 R, 193 A, 193 B, 191 R, 191 A, 191 B, 192, 186 A, 81 C, 81 D, 77 R, 32 H, 32 E, 162 R, 163 A, 194 R

[56] References Cited

U.S. PATENT DOCUMENTS

| | | | |
|---|---|---|---|
| 1,536,512 | 5/1925 | McLaren | 273/186 A |
| 2,771,678 | 11/1956 | Hansen | 273/194 R |
| 3,273,892 | 9/1966 | Nolting | 273/163 A |
| 3,604,712 | 9/1971 | Prior | 273/191 R X |
| 4,053,160 | 10/1977 | Salata | 273/163 A X |
| 4,063,731 | 12/1977 | Kitay | 273/32 H X |

*Primary Examiner*—George J. Marlo

[57] ABSTRACT

Disclosed herein is a pivotal support spike attached to the shaft of a golf club which in one alignment thereof provides a stand-off for lifting the golf club handle off the ground when the golf club is laid thereon. More specifically, the inventive support includes a plastic sleeve mounted on the shaft immediately adjacent to the handle wrapping, said sleeve having mounted thereon a circular strap which, at the ends, is tied through a pivot screw to an angular spike. The spike includes a heel section extending orthagonally relative the length thereof, the heel section abutting the handle wrapping when the spike is extended away from the shaft.

1 Claim, 5 Drawing Figures

FIG. 1
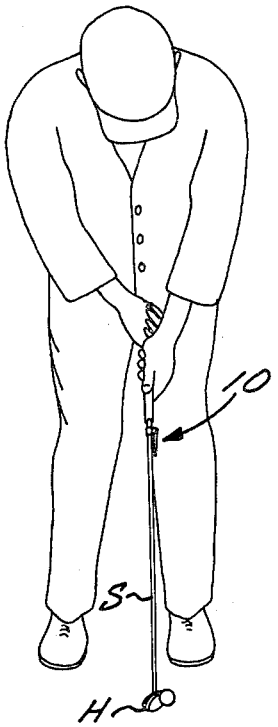
FIG. 2
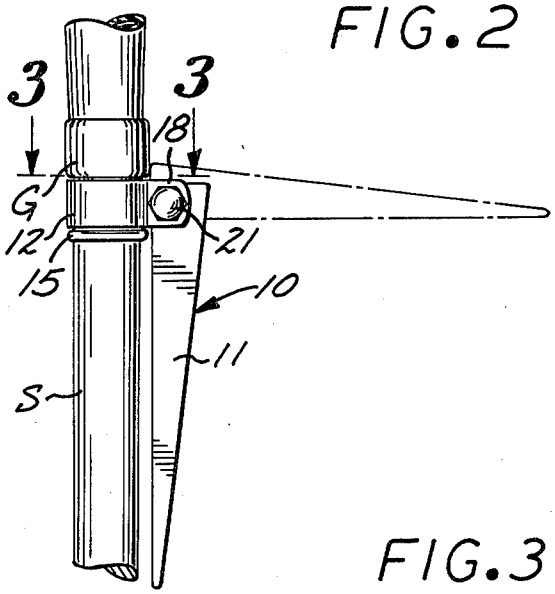
FIG. 3
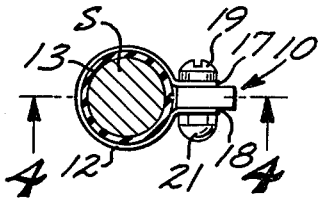
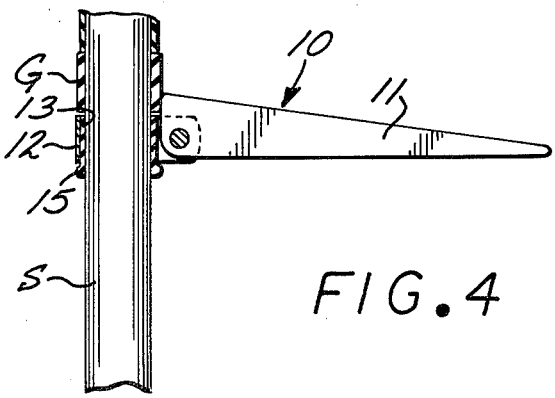
FIG. 4
FIG. 5
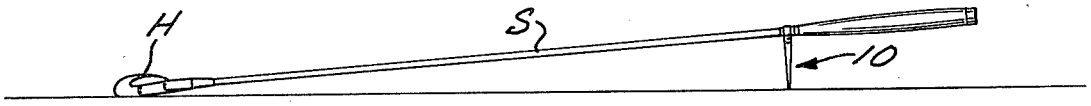

GOLF CLUB INCLUDING SUPPORT ATTACHMENT

BACKGROUND OF THE INVENTION

1. Field of the Invention

The present invention relates to support devices, and more particularly to a pivotal device adapted to support the handle of a golf club.

2. Description of the Prior Art

In the past there have been developed various limited club carriers by which a player can transport a selected number of clubs. Most typically carriers of this type are made to transport less than a full complement of clubs and are frequently utilized in golfing endeavors limited to putt and chip or other less complete golf exercises. In each instance the primary function of club carriers of this kind was to organize and support the clubs in some manner and in particular to maintain the handles of the unused clubs away from the ground and ready for play. Quite often a player will limit himself to exercise strokes involving no more than two or three clubs and for that reason a device which would maintain the club handles away from the ground as the other club is used as desired.

SUMMARY OF THE INVENTION

Accordingly it is the general purpose and object of the present invention to provide a club handle support whereby the handle of the unused golf clubs will be maintained above the ground surface.

Other objects of the invention are to provide a club handle support device which is conveniently attachable to the club and which by its structure does not interfere with the use of the club.

Yet additional objects of the invention are to provide a club handle support device which is easy to produce, convenient in use and requires no maintenance.

Briefly these and other objects are accomplished within the present invention by providing a pivoted spike, the plan form of the spike being substantially that of a right triangle, with the pivot extending through the spike proximate the right angle juncture thereof. The pivot, in turn, is attached to a circular strap which is supported on a plastic sleeve surrounding the shaft of a golf club. This circular strap may be deployed adjacent the handle wrapping on the shaft, and more preferably adjacent the normally found end grommet terminating the lower end of the club handle. In this deployment the short leg of the right triangle spike may be pivoted to abut the handle wrapping or grommet, thus maintaining the long leg of the spike substantially normal to the axis of the shaft. When deployed along a radial plane normal to the club face, the spike thus extended provides a standoff or support by which the club handle is lifted off ground. In its other position the spike is turned to align adjacent the shaft, thus presenting minimal interference with the use of the club.

By virtue of this arrangement of parts, a permanently affixed support structure is formed which, in its deployment does not alter materially the weight or the dynamic characteristics of the club.

BRIEF DESCRIPTION OF THE DRAWINGS

FIG. 1 is a perspective illustration of a golf club used by a player including the inventive support device mounted thereon;

FIG. 2 is a detail view of a club shaft having the inventive support device attached thereto;

FIG. 3 is a sectional view taken along line 3—3 of FIG. 2;

FIG. 4 is yet another detail view illustrating the alignment of the inventive support device for use in supporting a club; and FIG. 5 is an illustration of a golf club laid on ground, with the handle thereof supported by the device set out herein.

DESCRIPTION OF THE SPECIFIC EMBODIMENT

As shown in FIGS. 1 through 5, the inventive device, generally designated by the numeral 10, comprises a spike 11 having the plan form of an elongated right triangle and pivotally engaged to the ends of a circular strap 12 which is clamped onto a sleeve 13 mounted on the shaft S of a golf club. More specifically, the vertical disposition of a sleeve 13 on the shaft S is proximate the lower end of a normally found handle grommet G, the strap 12 retained longitudinally between the grommet and a bead 15 formed on the lower periphery of the sleeve.

The strap itself includes two end tabs 17 and 18 between which the aforementioned spike 11 is inserted. Tabs 17 ands 18 and the spike 11 includes a common bore, the bore extending proximate the right angle corner of the spike. Inserted in this bore is a screw 19 secured at the other end by a nut 21, the screw providing the pivot support for the spike.

To accommodate for pivotal motion, spike 11 is rounded at the right angle corner thereof, the pivotal deployment of the spike at one extreme presents the short end thereof against the adjacent surface of the grommet G and at the other extreme aligns the long edge thereof along the shaft S.

It is contemplated to arrange the alignment of tabs 17 and 18 along a plane substantially orthogonal to the face of the club head H, this alignment being maintained by the clamping achieved through the tightening of the screw 19 and to nut 21.

In this manner of attachment, spike 11 is either aligned along the shaft of the golf club, allowing for the normal play of the game and when deployed the face of the golf club together with the spike forms the necessary three point platform to maintain the handle above ground.

While it is contemplated to utilize relatively light material structures for the foregoing assembly of parts, the triangular plan form of the spike and disposition of this strap results in a weight bias proximate the handle thus producing very little alteration to the club weight distribution while achieving the desired result.

Obviously many modifications and changes may be made to the foregoing description without departing from the spirit of the invention. It is therefore intended that the scope of the invention be determined solely on the claims appended hereto.

What is claimed is:

1. In combination with a golf club that includes a head having a flat striking surface, a shaft that has first and second ends, said first end of said shaft secured to said head, and a grip that envelops a portion of said shaft that extends inwardly from said second end thereof, a device for maintaining said grip above the ground surface when said club is angularly positioned relative to the latter and said flat striking surface resting on said ground surface, said device including:

a. a trianglar spike having a short edge joined to a long edge at substantially orthogonal alignment;

b. a resilient sleeve mounted on said shaft adjacent an inwardly disposed end of said grip, said sleeve including a peripheral bead around the distal periphery thereof;

c. a circular clamp mounted on said sleeve and disposed between said head and said grip, said clamp including a strip that substantially encircles said sleeve, said strip including a pair of laterally spaced end tabs that extend outwardly from said shaft and substantially normal to said striking surface, said pair of tabs having axially aligned first openings therein that are aligned with a second opening in said spike when an end portion of said spike in which said second opening is formed is disposed between said pair of tabs;

d. a screw that extends through said first and second openings, said screw including a head in abutting contact with one of said tabs, and a threaded shank that projects outwardly from the other of said tabs; and e. a nut that engages said threaded shank and pressure contacts the one of said tabs most adjacent thereto when said screw is tightened, with said screw when tightened applying pressure through said clamp to said sleeve to maintain it in a fixed longitudinal position on said shaft, and also forcing said pair of tabs into frictional contact with said spike to the extent said spike may be pivoted to a first position substantially parallel to said shaft when said spike is not in use or to a second position substantially normal to said shaft where it will support said grip above the ground surface when the outer extremity of said spike is in contact with the latter and said striking surface rests on said ground surface.

* * * * *